US006971209B1

(12) United States Patent
Blevins

(10) Patent No.: US 6,971,209 B1
(45) Date of Patent: Dec. 6, 2005

(54) STABILIZATION SYSTEM FOR AN ANCHOR AND METHOD OF USE THEREOF

(75) Inventor: William Bradford Blevins, Nashville, TN (US)

(73) Assignee: Home Pride, Inc., Nashville, TN (US)

( * ) Notice: Subject to any disclaimer, the term of this patent is extended or adjusted under 35 U.S.C. 154(b) by 0 days.

(21) Appl. No.: 10/424,274

(22) Filed: Apr. 28, 2003

(51) Int. Cl.[7] ..... E02D 5/80

(52) U.S. Cl. ..... 52/157; 52/155; 52/161; 248/156; 248/545; 248/530; 248/521; 248/507; 362/370; 362/147; 362/148; 362/240; 362/249; 408/35; 408/117; 408/124; 408/204; 408/207

(58) Field of Search ..... 52/157, 155, 161; 248/156, 545, 530, 521, 507; 362/370, 147, 362/148, 240, 249; 408/35, 117, 124, 204, 408/207

(56) References Cited

U.S. PATENT DOCUMENTS

| | | | | |
|---|---|---|---|---|
| 200,217 A | | 2/1878 | Mudgett | |
| 571,624 A | | 11/1896 | Ryan | |
| 3,599,380 A | | 8/1971 | Menzi | |
| 3,676,965 A | | 7/1972 | Deike | |
| 3,724,237 A | * | 4/1973 | Wood | 464/177 |
| 4,863,137 A | | 9/1989 | Cockman et al. | |
| 4,923,165 A | * | 5/1990 | Cockman | 248/545 |
| 5,011,107 A | | 4/1991 | Reece | |
| 5,113,627 A | | 5/1992 | Jarrett, Sr. | |
| 5,123,623 A | | 6/1992 | McNamara | |
| 5,135,192 A | | 8/1992 | Winkler | |
| 5,139,235 A | | 8/1992 | Kilmer | |
| 5,199,361 A | * | 4/1993 | Robinson | 109/51 |
| D336,125 S | | 6/1993 | Sadler | |
| 5,295,766 A | | 3/1994 | Tiikkainen | |
| 5,649,690 A | | 7/1997 | Kilmer | |
| D382,034 S | | 8/1997 | Dullinger | |
| 5,697,600 A | | 12/1997 | Fingerson et al. | |
| 5,884,874 A | | 3/1999 | Speece et al. | |
| 5,906,077 A | | 5/1999 | Andiarena | |
| 5,927,677 A | | 7/1999 | Speece et al. | |
| 5,930,959 A | | 8/1999 | Van Halteren | |
| 6,128,867 A | * | 10/2000 | MacKarvich | 52/157 |
| 6,272,798 B1 | * | 8/2001 | Cockman | 52/155 |
| 6,298,611 B1 | | 10/2001 | Oliver et al. | |
| 6,318,032 B2 | | 11/2001 | MacKarvich | |
| 6,334,279 B1 | | 1/2002 | Oliver et al. | |

(Continued)

OTHER PUBLICATIONS

*Home Pride Technical Reference Guide*, Home Pride, Inc. (Jul. 1998).

*Primary Examiner*—Naoko Slack
*Assistant Examiner*—Christy M. Green
(74) *Attorney, Agent, or Firm*—Waddey and Patterson; Lucian Wayne Beavers

(57) ABSTRACT

A stabilization system, including a drive head, stabilization cap and anchor is provided for boring an anchor into the ground and engaging the stabilization cap with the surface of the ground. The drive head engages the head of the anchor and the stabilization cap. Accordingly, rotation of the drive head results in rotation of the anchor and stabilization cap. It is by rotation that the anchor bores into the ground, the shaft of the anchor is placed at the center of the stabilization cap, and the stabilization cap engages the surface of the ground. After setting the anchor, the stabilization cap opposes lateral movement of the upper end of the anchor.

24 Claims, 5 Drawing Sheets

U.S. PATENT DOCUMENTS 6,334,281 B1 * 1/2002 Oliver et al. ..... 52/157
6,343,449 B1 2/2002 MacKarvich
6,418,685 B1 7/2002 Oliver et al.
6,505,447 B1 1/2003 Oliver et al.

* cited by examiner

STABILIZATION SYSTEM FOR AN ANCHOR AND METHOD OF USE THEREOF

BACKGROUND OF THE INVENTION

The present invention provides an anchor system used for securing structures, such as mobile homes, to the ground. The present invention has other uses independent of securing mobile homes.

Anchors have commonly been used to secure structures to the ground in order to prevent damage that may result from the collapse, rolling or moving of the structures. Such anchor systems commonly include an anchor that is bored into the ground soil and a means of connecting ropes, chains, tension straps or other tethers to the anchor. Examples of currently known anchor systems include, U.S. Pat. No. 6, 272,798 to Cockman, U.S. Pat. No. 6, 334,281 to Oliver et al., and U.S. Pat. No. 6, 298,611 to Oliver et al.

Certain anchor systems include a stabilization cap, or compression cap, for stabilizing the position of the upper portion of the anchor which is bored into the ground. Currently known anchor systems do not provide a means for rotating an unattached stabilization cap as the anchor rotates so that the stabilization cap firmly engages the surface of the ground. Also, the currently known anchor systems do not require that the shaft of the anchor is located at the center of the stabilization cap. What is needed then, is a system for properly positioning the stabilization cap relative to the shaft of the anchor while boring the anchor into the ground. An apparatus is needed that will unify the two steps of boring the anchor and properly positioning the stabilization cap.

SUMMARY OF THE INVENTION

The present invention is a ground anchor system and method of use thereof for preventing lateral movement of an anchor that has been placed into the ground in order to hold a structure in place. The anchor system includes an anchor, stabilization cap, and drive head. The anchor includes an anchor head, shaft and augers. The stabilization cap includes a plate having an L-shaped groove and a downward facing flange. The drive head is a five-sided structure having an engagement tooth, so that the drive head engages and simultaneously rotates the anchor and the stabilization cap.

The drive head is placed over the anchor head in order to engage and rotate the anchor. The engagement tooth of the drive head projects downwardly and into the L-shaped groove of the stabilization cap for engaging and rotating the cap. The shaft of the anchor must be inserted through the long arm of the L-shaped groove into the short arm of the L-shaped groove of the stabilization cap so that the engagement tooth aligns with the groove of the stabilization cap. Thus, when the shaft is positioned in the short arm of the groove, at or near the center of the stabilization cap, the engagement tooth will engage the groove.

Upon clockwise rotation of the drive head, the engagement tooth pivots within the groove of the stabilization cap so that the shaft of the anchor moves within the short arm of the L-shaped groove and ultimately to the center of the stabilization cap, if it was not originally positioned there. As the drive head continues its rotation, the anchor is bored into the ground and the downward facing flange of the stabilization cap engages the ground in order to oppose any lateral movement of the anchor after it has been positioned. After proper positioning of the anchor and stabilization cap, a tension strap is attached to the anchor head so that the anchor bears load and attaches a mobile home or other structure to the ground.

In certain embodiments of the present invention, a housing is attached to the top of the drive head for attaching an anchor drive machine to the drive head. In other embodiments of the present invention, the downward facing flange of the stabilization cap is about a periphery of the stabilization cap.

In still other embodiments of the present invention, the drive head has openings on two of the four horizontal sides, which are parallel, for receiving a fastener that attaches the drive head to the anchor head.

Therefore, one aspect of the present invention is the provision of an anchor system in which the stabilization cap rotates with the anchor to achieve superior engagement with the surface of the ground.

Another aspect of the present invention is the provision of a drive head having an engagement tooth for engaging a stabilization cap.

Yet another aspect of the present invention is the provision of a stabilization cap having a right handed L-shaped groove so that the shaft of an anchor is forced into the center of the stabilization cap upon the clockwise rotation of the drive head.

Another aspect of the present invention is a method of boring an anchor into the ground while the stabilization cap rotates with the anchor so that the shaft of the anchor is placed in the center of the stabilization cap and the stabilization cap is firmed engaged with the ground surface.

Still another aspect of the present invention is a method of boring an anchor into the ground so that a stabilization cap having a downward flange effectively engages the ground in order to oppose lateral movement of the upper portion of the anchor when a tension strap is attached to the anchor in order to support a structure.

Upon rotation of the drive head 14 the engagement tooth 24 will align with and engage the L-shaped groove 36 of the stabilization cap 12.

Figure 8:
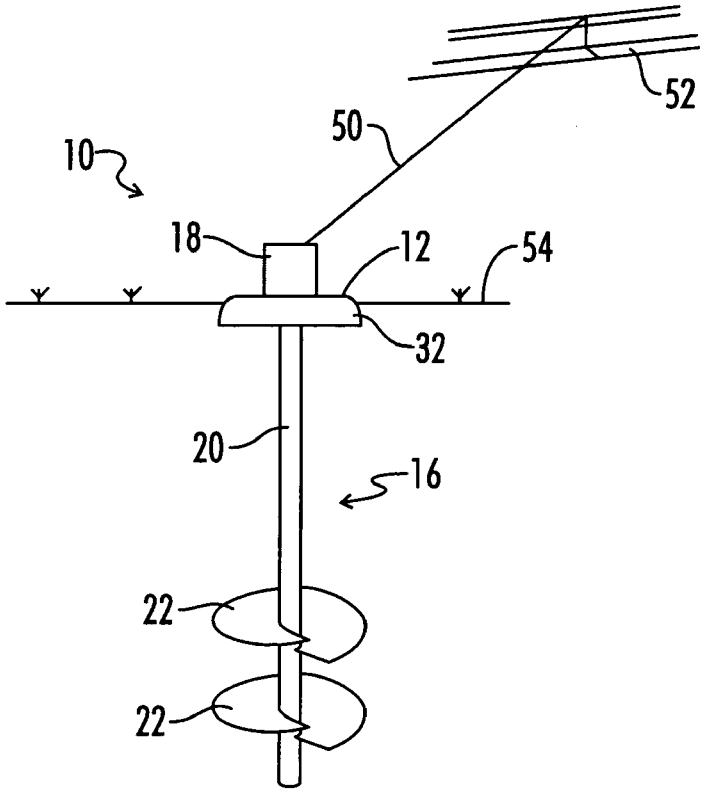

FIG. 8 is a drawing of the anchor system 10 with a tension strap 50 attached to a structure 52. The stabilization cap 12 stabilizes the anchor 16 so that the anchor system 10 successfully holds the load presented by the tension strap 50.

Figure 9:
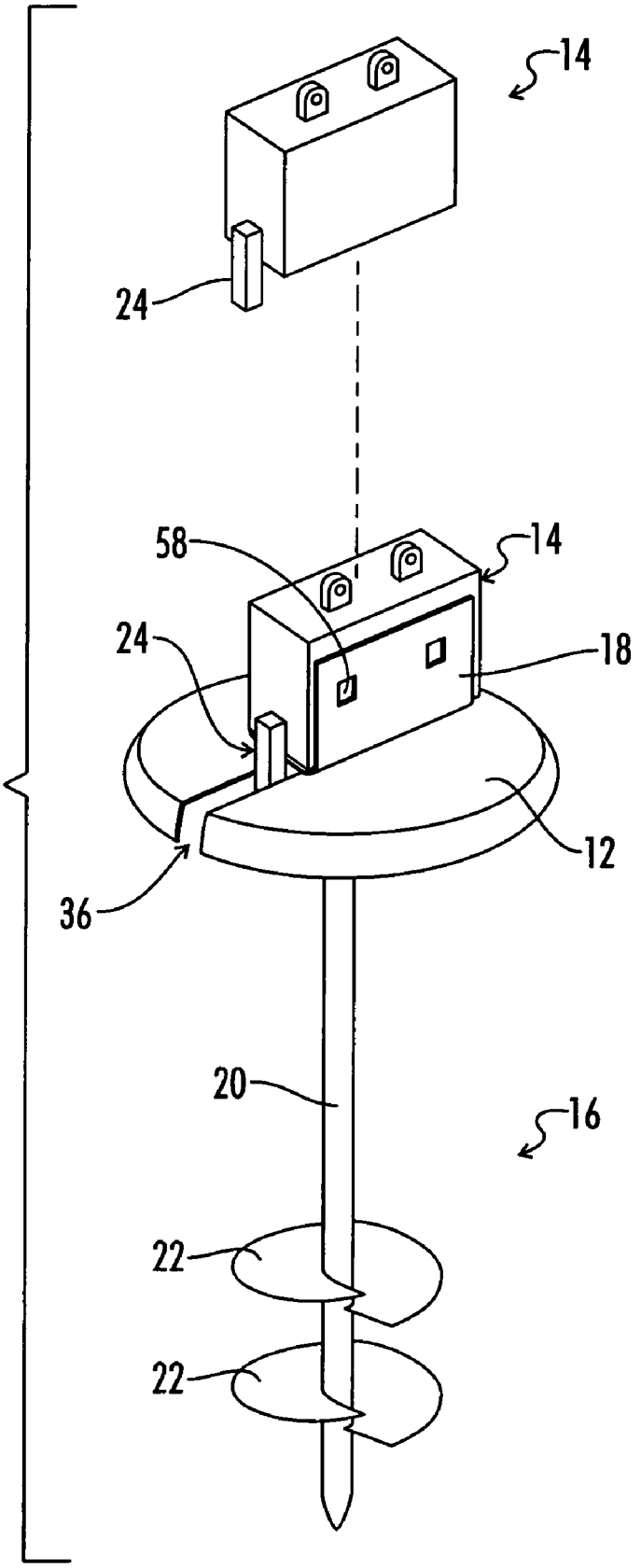

FIG. 9 is a perspective view of an embodiment of the present invention showing the drive head 14 engaged within the anchor head 18. This embodiment also results in the engagement tooth 24 engaging the L-shaped groove 36 so that rotation of the drive head 14 results in rotation of the anchor 16 and stabilization cap 12.

DESCRIPTION OF THE PREFERRED EMBODIMENTS

Figure 1:
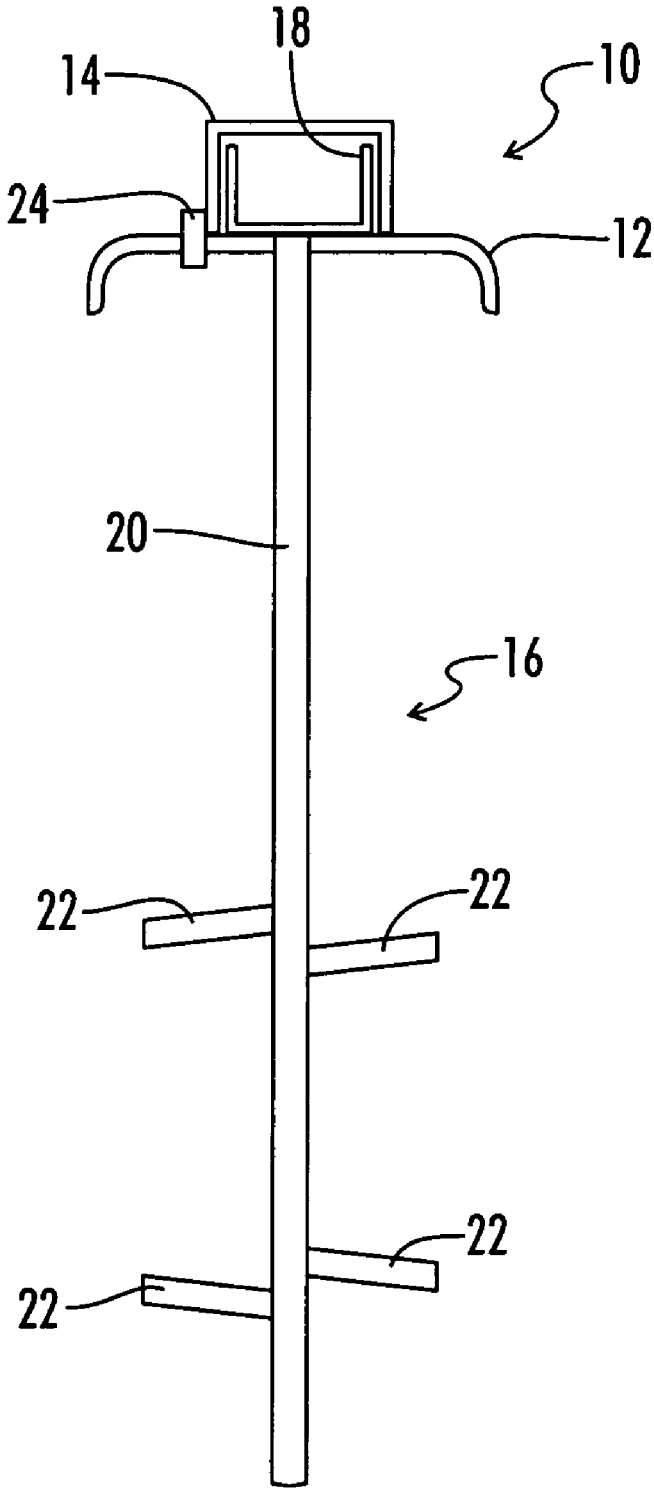
FIG. 1 is a cross sectional view of one embodiment of the present invention. The figure shows engagement of the anchor head 18 by the drive head 14 as well as the engagement tooth's 24 interaction with the stabilization cap 12.

The present invention disclosed herein is an anchor system 10 for stabilizing a ground anchor. In order to prevent movement of the upper end of an anchor 16, the anchor system 10 provides an anchor 16, stabilization cap 12, and a drive head 14. As seen in FIG. 1, the anchor system 10 includes an anchor 16 having an anchor head 18, a shaft 20 and at least one auger 22. Such anchors are readily available from commercial sources. The present anchor system 10 provides a drive head 14 which engages the anchor head 18 and the stabilization cap 12 so that the anchor 16 and the stabilization cap 12 are rotated when the drive head 14 is rotated.

The anchor system 10 is bored into the ground such that the augers 22 hold the anchor 16 in a fixed position. The stabilization cap 12 compresses the soil between it and the augers 22. Once the anchor system 10 is placed in a fixed position, ropes, chains, or other tension straps may be attached to the anchor head 18 so that the anchor system 10 bears a load, as further described below.

Figure 2:
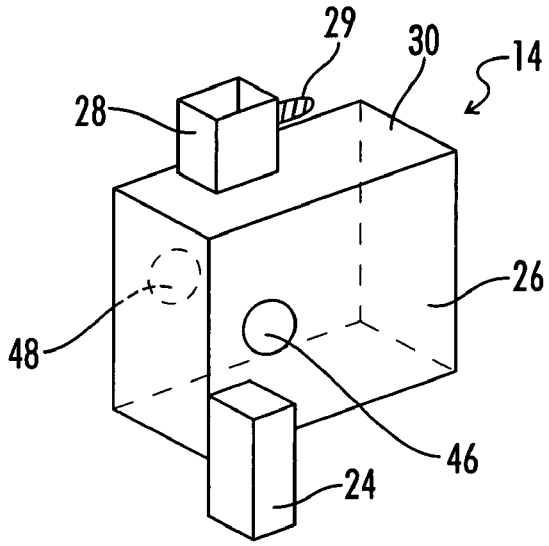
FIG. 2 is a perspective view of the drive head 14. The figure shows the engagement tooth 24 extending from the first side 26. Also shown is the housing 28 used to attach an anchor drive machine to the drive head 14.

Shown in FIG. 2 is the drive head 14 of the anchor system 10. The drive head 14 is an adapter or interface between a rotation source, such as an anchor drive machine, and the anchor head 18 of the anchor 16 and the stabilization cap 12. The drive head 14 may be constructed of steel, metal, or other material capable of enduring the forces and stresses described herein. In certain embodiments, the drive head 14 is constructed of one quarter inch thick steel.

The drive head 14 is a five-sided receptacle, or body, having four vertical sides and a top 30. The drive head 14 has an engagement tooth 24 attached to a first side 26 of the four vertical sides. The engagement tooth 24 is a solid structure, not hollow, and has a square or rectangular shape with a minimum width of ¼ inches. Preferably, the engagement tooth 24 has a width of ½ to one inch. The engagement tooth 24 projects downwardly in order to engage the stabilization cap 12, as further discussed below. The drive head 14 additionally provides a socket or housing 28 which is attached to the top 30 of the drive head 14 so that the anchor drive machine attaches to the drive head 14. The screw 29 is used to tighten the male portion of the anchor drive machine into the housing 28. In certain embodiments, further described below, the drive head 14 has a first opening 46 and a second opening 48 for receiving a fastener 56 (shown in FIG. 7) for attachment to the anchor head 18.

In an alternate embodiment of the present invention, the drive head 14 may be a male portion that is received by a female portion of the anchor head 18, as shown in FIG. 9. As shown in FIG. 9, the anchor head 18 receives the drive head 14 so that rotation of the drive head 14 results in rotation of the anchor head 18 of the anchor 16. Further, the engagement tooth 24 of the drive head 14 engages the L-shaped groove 36 of the stabilization cap 12, in order to provide rotation of the stabilization cap 12. Thus, clearly a male/female reversal of the drive head 14 and anchor head 18 is an alternate embodiment of the present invention. Accordingly, when the engagement, or attachment, of the drive head 14 and anchor head 18 are described herein, such description shall include an understanding that a male/female reversal is considered within the scope of the present invention.

Figure 3:
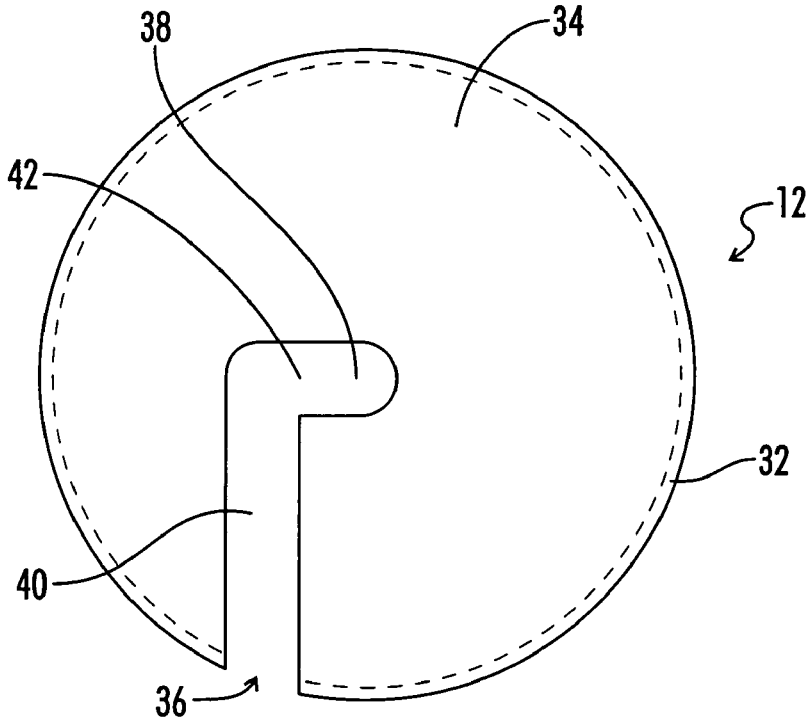
FIG. 3 is a top view of the stabilization cap 12 showing the center 38 of the cap and the L-shaped groove 36 having a short arm 42 and a long arm 40.

As shown in FIG. 3, the stabilization cap 12 is a plate 34 having a generally planar surface and a downward facing flange 32. The stabilization cap 12 may be made of any material, such as steel or other metal. Preferably, the stabilization cap 12 is constructed of 9-gage H.R.P.O. In a certain embodiment, the plate 34 has a diameter of about 6.5 inches, a groove 36 width of about 0.75 inches, and the center of the groove 36 is offset to the left side of the center 38 of the stabilization cap 12 by from about 0.82 inches to about 0.94 inches.

The stabilization cap 12 additionally has an L-shaped groove 36. The L-shaped groove 36, also called a groove, has a right-handed L-shape. The L-shaped groove 36 has a long arm 40 and a short arm 42. In certain embodiments, the long arm 40 of the groove 36 is from the periphery of the plate 34 to an area which is offset from the center 38 of the stabilization cap 12. The short arm 42 of the groove 36 extends from the center 38 of the stabilization cap 12 to the end of the long arm 40 of the groove 36 which is offset to the left of the center 38. Stated another way, the long arm 40 of the groove 36 is from the periphery of the stabilization cap 12 to the near center area of the stabilization cap 12 located left of the center 38 of the stabilization cap 12. The short arm 42 of the groove 36 is perpendicular to the long arm 40 and is from the near center area located left of the center 38 of the stabilization cap 12 to the center 38. The orientation of the L-shaped groove 36 is critical to the clockwise rotation necessary to bore the anchor 16 into the ground. As will be described in greater detail below, the shaft 20 of the anchor 16 moves within the short arm 42 of the groove 36, and ultimately to the center 38 of the stabilization cap 12 or within about ⅛ of an inch thereof, due to the clockwise rotation of the drive head 14 which has engaged the anchor head 18 of the anchor 16 and the L-shaped groove 36 of the stabilization cap 12.

Figure 4:
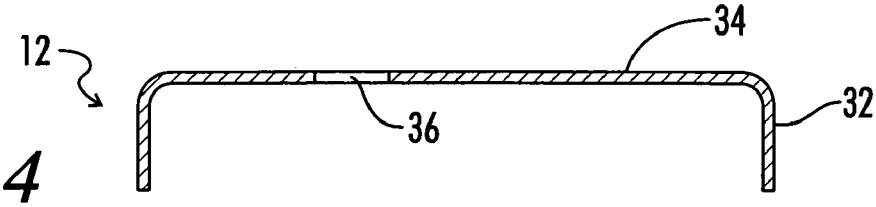
FIG. 4 is a cross-sectional view of the stabilization cap 12. The figure shows the plate 34 and the downward flange 32.

As seen in FIG. 4, in certain embodiments of the stabilization cap 12, the downward facing flange 32 may be located at the periphery of the plate 34. In certain embodiments, the flange 32 is approximately one inch in length. In still other embodiments, the flange 32 length is from about ½ inch to two inches. In other embodiments, the downward facing flange 32 may be located at a position other than the periphery, such as a downward facing ring located around a central point of the plate 34 of the stabilization cap 12.

The L-shaped groove 36 of the stabilization cap 12 has a predetermined width. The groove 36 has a width sufficient in size for insertion of the shaft 20 of the anchor 16. The width of the groove 36 is also sufficient in size for insertion of the engagement tooth 24 of the drive head 14. In certain embodiments, the width of the groove 36 is from about ½ inch to about 1 inch. In other embodiments, the width of the groove 36 is about 0.75 inches. The width of the groove 36 must always be sufficient in size relative to the size of the engagement tooth 24 such that the engagement tooth 24 is capable of pivoting within the groove 36.

Figure 5:
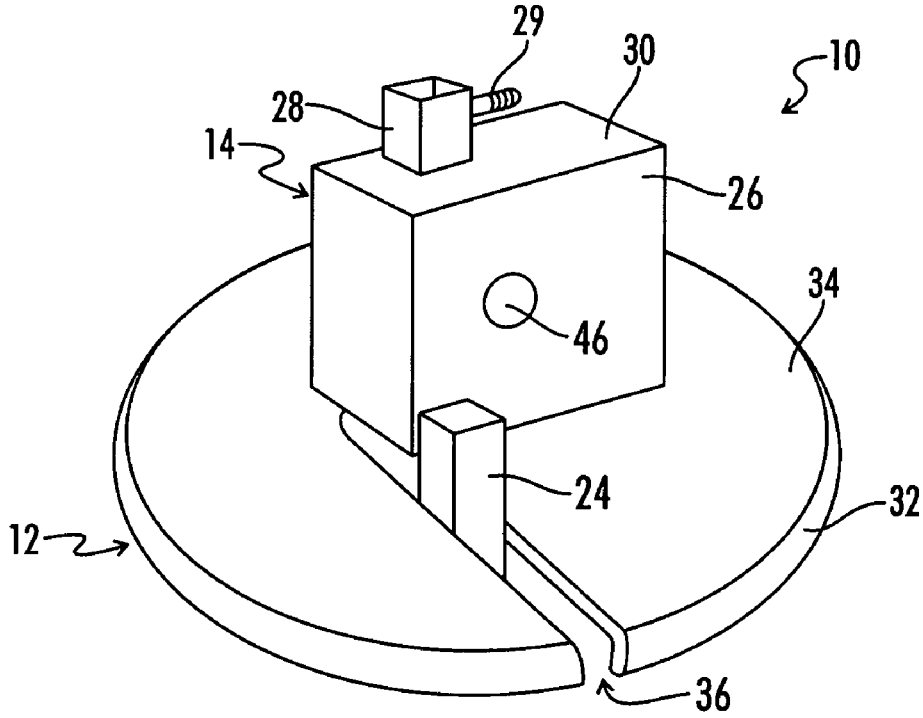
FIG. 5 is a perspective view of the anchor system 10. The figure shows the drive head 14 having an engagement tooth 24 engaging the L-shaped groove 36 of the stabilization cap 12.
Figure 6:
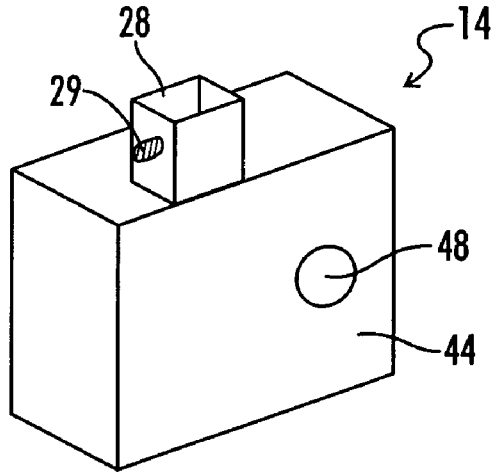
FIG. 6 is a perspective view of the drive head 14 showing the second side 44 having a second opening 48 for receiving a fastener. The engagement tooth of the drive head 14 is attached on the opposite side and, consequently, is not shown.
Figure 7:
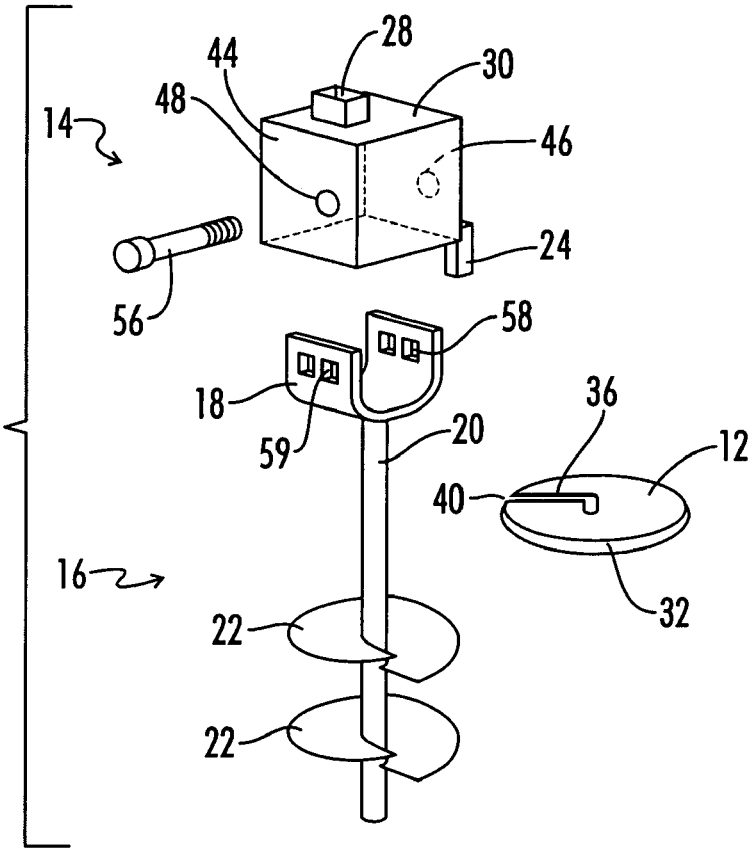
FIG. 7 is a perspective view of the anchor system 10. The drive head 14 is properly aligned to engage the anchor head 18 in order to rotate the anchor 16. The stabilization cap 12 is properly aligned to engage the shaft 20 of the anchor 16.

As best seen in FIG. 5, the drive head 14 engages the anchor 16 and the stabilization cap 12 so that all three rotate simultaneously. The drive head 14 is placed over the anchor head 18 (not shown). The engagement between the drive head 14 and the anchor head 18 rotates the anchor head 18 upon rotation of the drive head 14. In some embodiments, the drive head 14 is also attached to the anchor head 18 with a fastener 56 (shown in FIG. 7). More specifically, as shown in FIGS. 5–7, the first side 26, also called a first of the vertical sides, has a first opening 46 and the second side 44, also called a second of the vertical sides, has a second opening 48 so that a fastener 56 engages the openings in order to attach the drive head 14 to the anchor head 18. The anchor head 18 has a first opening 58 and a second opening 59 which correspond to the first opening 46 and the second opening 48 so that a fastener 56, such as a bolt, lug bolt or other cylindrical means, can be used to attach the drive head 14 to the anchor head 18. The second side 44 having the second opening 48 is best seen in FIG. 6.

Also shown in FIG. 5 is the engagement of the stabilization cap 12 with the drive head 14. The engagement tooth 24 serves at least two functions, it engages the stabilization cap 12 and also allows the drive head 14 to pivot. Pivoting is allowed because the width of the engagement tooth 24 is less than the width of the groove 36.

Shown in FIGS. 1, 5, 7, 8 and 9, the stabilization cap 12 engages the shaft 20 of the anchor 16. Engagement occurs when the shaft 20 is inserted into the L-shaped groove 36. The shaft 20 is inserted into the long arm 40 of the groove 36 and then into the short arm 42 of the groove 36 so that the engagement tooth 24 of the drive head 14 is also capable of inserting into the long arm 40 of the groove 36.

FIG. 8 also shows the anchor system 10 supporting a structure 52. Once the anchor system 10 is properly positioned, a tension strap 50 is attached to the anchor head 18 and the structure 52. The stabilization cap 12 has engaged the surface of the ground 54 in order to prevent lateral movement of the anchor 16.

METHODS OF STABILIZING AN ANCHOR

Also disclosed herein is a method of boring an anchor into the ground and stabilizing the anchor. The method includes providing specific structures disclosed herein, such as a drive head 14 with an engagement tooth 24, a stabilization cap 12, also called a cap, having a downward facing flange 32 and an L-shaped groove 36, and an anchor 16 having an anchor head 18, shaft 20, and an auger 22. The orientation of the L-shaped groove 36 of the cap is important. The L-shaped groove 36 should have a short arm 42 and a long arm 40, the short arm 42 of the groove 36 extending from the center 38 of the cap to a location left of the center 38, as shown in FIG. 3. The long arm 40 of the groove 36 runs perpendicular to the short arm 42 and from the short arm 42 to the periphery of the cap 12.

The method of the present invention further includes engaging the drive head 14 with the anchor 16, rotating the drive head 14, inserting the shaft 20 of the anchor 16 and the engagement tooth 24 of the drive head 14 into the groove 36, and rotating the drive head 14 so that the anchor 16 and cap 12 rotate. In certain embodiments of the present invention, the method includes pivoting the engagement tooth 24 within the groove 36 so that the shaft 20 of the anchor 16 is positioned at the center 38 of the cap 12. Other embodiments include engaging the flange 32 of the cap 12 with the surface of the ground 54. The method includes attaching a tension strap 50, or equivalent, to the anchor head 18 so that the anchor 16 bears load.

As best seen in FIG. 7, the drive head 14 engages the anchor head 18 by being placed over the anchor head 18. As previously described, in certain embodiments, the drive head 14 may be attached to the anchor head 18 by threading a fastener 56 through the corresponding opening 58. In other embodiments, the interlocking engagement between the drive head 14 and the anchor head 18 is sufficient. In still other embodiments, there is a male/female reversal of the drive head 14 and anchor head 18 as described herein.

The drive head 14 is then rotated so that the anchor 16 rotates. The drive head 14 may be manually rotated or rotated by an anchor drive machine which attaches to the housing 28 of the drive head 14. Rotation of the anchor 16 in a clockwise motion results in the augers 22 boring into the ground.

When the anchor head 18 is from about 6 inches to 18 inches from the surface of the ground, the stabilization cap 12 is positioned to insert the shaft 20 of the anchor 16 into the L-shaped groove 36. The portion of the shaft 20 which is inserted into the groove 36 is the portion between the anchor head 18 and the upper most auger 22. In certain embodiments, the shaft 20 of the anchor 16 is positioned within the short arm 42 of the L-shaped groove 36 and the stabilization cap 12 is rotated in order to align the long arm 40 of the L-shaped groove 36 with the downward protruding engagement tooth 24 of the drive head 14. The engagement tooth 24 is inserted into the long arm 40 of the L-shaped groove 36.

After such engagement, when the drive head 14 is rotated, the anchor 16 and the stabilization cap 12 will also rotate. Such further clockwise rotation results in the anchor 16 further boring into the ground so that the stabilization cap 12 is forced against the bottom of the anchor head 18 by the surface of the ground.

While rotating, the drive head 14 pivots relative to the cap 12. The pivoting action results in the shaft 20 of the anchor 16 moving within the short arm 42 of the L-shaped groove 36. When the shaft 20 is positioned at the end of the short arm 42 of the L-shaped groove 36 it is positioned at the center 38 of the cap 12. Alternately, the shaft 20 may be positioned within about ⅛ of an inch of the center 38 of the cap 12.

This method additionally includes engaging the flange 32 of the stabilization cap 12 with the surface of the ground. As shown in FIG. 8, the flange 32 is located about the periphery of the stabilization cap 12 and is engaging the surface of the ground 54. In other embodiments of the present invention, the flange 32 may be located in a position closer to the center 38 of the stabilization cap 12.

Subsequent to the boring of anchor 16 and stabilization cap 12 and the flange 32 of the stabilization cap 12 into the ground, a tension strap 50 is attached to the anchor head 18 so that the anchor 16 bears load. As best seen in FIG. 8, the tension strap 50 is attached to the anchor head 18 and a structure 52, such as a mobile home. Lateral movement of the upper end of the anchor 16 is opposed due to the engagement of the flange 32 of the stabilization cap 12 with the surface of the ground 54.

All references, publications, and patents disclosed herein are expressly incorporated by reference.

Thus, it is seen that the apparatus and method of the present invention readily achieves the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the following claims.

What is claimed is:

1. An anchor system, comprising:

an anchor having an anchor head, shaft and an auger;

a stabilization cap removably engaged to the shaft of the anchor, the stabilization cap having a downward facing flange; and a drive head removably engageable with both the anchor head and the stabilization cap, the drive head having an engagement tooth, the drive head adapted to removably engage the anchor head with the engagement tooth removably engaging the stabilization cap, so that the drive head simultaneously rotates the anchor and the stabilization cap.

2. The anchor system of claim 1, wherein the engagement tooth of the drive head projects downwardly.

3. The anchor system of claim 2, wherein the stabilization cap includes a planar plate having a groove therein, the groove having an L-shape, the groove having a width sufficient in size for insertion of the shaft of the anchor.

4. The anchor system of claim 3, wherein the groove has a long arm and a short arm of the L-shape, the long arm is from a periphery of the planar plate of the stabilization cap to a near center area of the planar plate of the stabilization cap located left of a center of the planar plate of the stabilization cap, the short arm perpendicular to the long arm and from the near center area located left of the center of the planar plate of the stabilization cap to the center of the planar plate of the stabilization cap.

5. The anchor system of claim 3, wherein the width of the groove is from about 0.5 inches to about 1.0 inch.

6. The anchor system of claim 3, wherein the engagement tooth has a width that is less than the width of the groove.

7. The anchor system of claim 1, wherein the downward facing flange is about a periphery of the stabilization cap.

8. A method of boring an anchor into the ground and stabilizing the anchor, comprising:

providing a drive head having an engagement tooth;

providing a cap having a central plate and a downward facing flange and an L-shaped groove defined in the central plate, the L-shaped groove having a short arm and a long arm, the short arm extending from a center of the central plate of the cap to a location offset to a left of the center, the long arm extending from a periphery of the cap to the short arm;

providing an anchor having an anchor head, shaft, and an auger;

engaging the drive head with the anchor head;

rotating the drive head so that the anchor rotates;

then inserting the shaft of the anchor and the engagement tooth of the drive head into the L-shaped groove; and then rotating the drive head so that the anchor and the cap rotate.

9. The method of claim 8, further comprising pivoting the engagement tooth within the L-shaped groove so that the shaft of the anchor is positioned at the center of the cap.

10. The method of claim 9, further comprising engaging the flange of the cap with a surface of the ground.

11. The method of claim 10, wherein the downward facing flange of the cap is about a periphery of the cap.

12. The method of claim 10, further comprising attaching a tension strap to the anchor head so that the anchor bears load.

13. An anchor system, comprising:

an anchor having an anchor head, a shaft and an auger;

a stabilization cap including a circular plate having an L-shaped groove defined therein, and having a center of the circular plate of the stabilization cap defined by an end of the L-shaped groove, the L-shaped groove adapted to engage the shaft of the anchor between the anchor head and the auger; and a drive head having four sides and a top, the drive head having an engagement tooth for engaging the L-shaped groove of the stabilization cap.

14. The anchor system of claim 13, wherein the L-shaped groove is right handed so that clockwise rotation of the drive head forces the shaft of the anchor to the center of the stabilization cap.

15. The anchor system of claim 13, wherein the groove is sufficient in size to allow the shaft of the anchor to pass therethrough.

16. The anchor system of claim 13, wherein the engagement tooth is a downward protuberance attached to one of the four sides.

17. The anchor system of claim 13, wherein the drive head defines a first opening on a first of the sides and a second opening on a second of the sides, the first and second sides being parallel and opposite.

18. The anchor system of claim 17, wherein the anchor head has a first opening and a second opening defined therein, so that a fastener engages the openings of the drive head and corresponding openings of the anchor head in order to attach the drive head to the anchor head.

19. A drive head for attaching to and rotating an anchor, comprising:

a body having sides and a top; and an engagement tooth fixedly attached to and extending downward from one of the sides.

20. The drive head of claim 19, further comprising a housing attached to and extending upward from the top of the body for attaching an anchor drive machine to the drive head.

21. The drive head of claim 19, wherein a first and second side of the sides of the body have first and second openings, respectively, defined therein, the first and second sides being parallel.

22. The drive head of claim 21, further comprising a fastener received through the first opening of the first side and the second opening of the second side.

23. A stabilization cap for engaging an anchor shaft and stabilizing the anchor, comprising:

a plate having a planar surface, a downward facing flange, and a groove defined by the plate, wherein the groove is L-shaped, the groove having a long arm of the L-shape from a periphery of the plate to a center area of the plate and having a short arm of the L-shape from the long arm to a center of the plate.

24. The stabilization cap of claim 23, wherein the groove has a width greater than about 0.75 inches for engaging an anchor shaft.

* * * * *